United States Patent [19]

Szalony

[11] 4,062,482

[45] Dec. 13, 1977

[54] INTEGRALLY FORMED BALL CARRIER

[76] Inventor: Norman Szalony, 8326 Evangeline, Dearborn Heights, Mich. 48127

[21] Appl. No.: 635,678

[22] Filed: Nov. 26, 1975

[51] Int. Cl.[2] ..... A45F 5/02

[52] U.S. Cl. ..... 224/5 D; 224/45 L

[58] Field of Search ..... 224/5 D, 5 R, 5 A, 5 C, 224/45 L, 29 B; 206/315 B; D87/1 R; D34/5 QQ; D2/400; 211/14

[56] References Cited

U.S. PATENT DOCUMENTS

| | | | |
|---|---|---|---|
| 1,911,256 | 5/1933 | Andrew | 224/5 D |
| 2,548,330 | 4/1951 | Wiseman | 224/5 D |
| 2,665,830 | 1/1954 | Fowler | 224/5 D |
| 3,497,118 | 2/1970 | Najjar | 224/5 D |

FOREIGN PATENT DOCUMENTS

| | | | |
|---|---|---|---|
| 573,899 | 4/1959 | Canada | 224/5 D |
| 746,492 | 3/1933 | France | 224/45 L |
| 1,056,460 | 2/1954 | France | 224/45 L |

*Primary Examiner*—Robert J. Spar
*Assistant Examiner*—Jerold M. Forsberg
*Attorney, Agent, or Firm*—Irving M. Weiner; Pamela S. Austin

[57] ABSTRACT

A one-piece device for holding balls having an integral clip for clipping on the top edge of the wearer's garment. The device may be made from plastic or any other material having some resiliency enabling the temporary retention of the balls. The device is arranged so that linear translation permits the ball to be inserted into or removed from the device.

5 Claims, 5 Drawing Figures

INTEGRALLY FORMED BALL CARRIER

The present invention relates generally to a device for readily and removably holding at least one arcuate object, and methods of constructing and utilizing same. The terminology "arcuate object" as used herein is intended to connote balls, spheres, ellipsoids, spheroids, surfaces and solids of revolution, egg-like objects, ovular objects, and any three-dimensional objects having at least a portion of their surfaces which is curved.

In particular, the present invention relates to a one-piece device for holding one or more balls and having an integral clip for clipping onto the top edge of a garment of the wearer thereof.

BACKGROUND OF THE INVENTION

Heretofore, there had not been developed any generally acceptable or workable device which lent itself to the ready retention or removal of tennis balls, golf balls, baseballs, etc. by players or umpires. Those devices which were attempted invariably were cumbersome, awkward, required considerable skill for the insertion and removal of the balls, and invariably interfered with the player utilizing the device.

Consequently, there developed a desideratum for a device which avoided the disadvantages and drawbacks mentioned hereinabove. The apparent animadversion set forth hereinabove with respect to the prior art developments will be seen to be quite justified and accurate by directing attention to the following prior art developments discussed hereinbelow.

In 1931 Frederick W. Bender was granted United States Letters Pat. No. 1,814,887 entitled "UMPIRE'S BELT" that discloses a belt which is to be worn by an umpire and which carries a number of baseballs for use. The belt has a plurality of spaced resilient open-ended supports, one for each ball. Each support is composed of two U-shaped flat spring members which are connected together in a cruciform at their base and which are attached to a belt in such a way as to prevent rotation.

In 1937 Fred J. Hatley was granted United States Letters Pat. No. 2,074,180 entitled "TENNIS BALL HOLDER" which discloses a device to hold a tennis ball on the player by attaching it to the belt or the shorts of the player. The device is comprised of a pair of resiliently-mounted rings of approximately the same diameter as a tennis ball which are made of spring wire. The rings are attached to a base, which in turn hooks onto the belt or shorts of the player.

In 1951 Eugene R. Wiseman was granted United States Letters Pat. No. 2,548,330 entitled "GOLF BALL HOLDER" which discloses a device for holding two golf balls on a golfer's belt. The holder is made from molded plastic material and consists of two hemispherical compartments to accept the golf balls which are held in place by two detents in the upper portion of each compartment. Also molded into the front of the holder is a clip to hold a pencil, and a second clip is molded in the rear to fasten to the golfer's belt.

In 1975 Noel G. Goudreau was granted United States Letters Pat. No. 3,873,009 entitled "BALL HOLDER" which discloses a two-part device for holding tennis balls. The device includes a base and a retaining ring which are joined together by means of a protrusion on the ring snapping into a recess in the upper portion of the base. The base has a cavity defining a spherical portion which is less than a hemisphere to accept a portion of the tennis ball. The base also has an integral clip composed of two fingers which clip over the player's shorts or pockets.

The present invention eliminates the disadvantages and shortcomings attendant with the conventional prior art technique, and at the same time provides a device and method which eminently fulfills the desideratum mentioned hereinabove with a minimum of parts and at an extremely surprising reduced cost of manufacture.

SUMMARY OF THE INVENTION

The present invention provides a device for readily and removably holding at least one arcuate object. The device includes a pair of resilient arcuate arm members which have an aperture therebetween into and out of which aperture the arcuate object may be readily and selectively placed and removed, respectively. The device also includes a base portion to which the pair of resilient arm members are operably interconnected. The base portion and the pair of resilient arm members constitute a unitary and integral structure. The base portion and the pair of resilient arm members are arranged and interconnected so that the arcuate object can be placed into and removed from the device by linearly translating the arcuate object substantially parallel to the major surface of a clip member of the device.

It is an object of the present invention to provide a novel device of a one-piece construction, and which may be extruded from plastic or any other material having suitable resiliency for permitting temporary retention of arcuate objects therein.

In accordance with a preferred embodiment of the present invention, there is provided a device wherein the extended plane of the inner plane of the clip member of the device interferes slightly with the outer edge of the lower ball retainer to assure that the lower ball retainer is biased outwardly from pressure against the player's leg or thigh.

Another object of the invention is to provide a device wherein the balls are held one above the other with the top inner portion of the clip being approximately on the horizontal centerline of the upper holder, and the vertical centerline of the lower holder being slightly further from the body of the wearer of the device than the vertical centerline of the upper holder.

Yet another object of the present invention is to provide a one-piece retainer device for selectively holding tennis balls, ping-pong balls, golf balls, baseballs, and the like.

Other objects and details of the invention will become apparent from the following description, when read in conjunction with the accompanying drawings.

DETAILED DESCRIPTION OF SOME PREFERRED EMBODIMENTS OF THE PRESENT INVENTION

Figure 1:
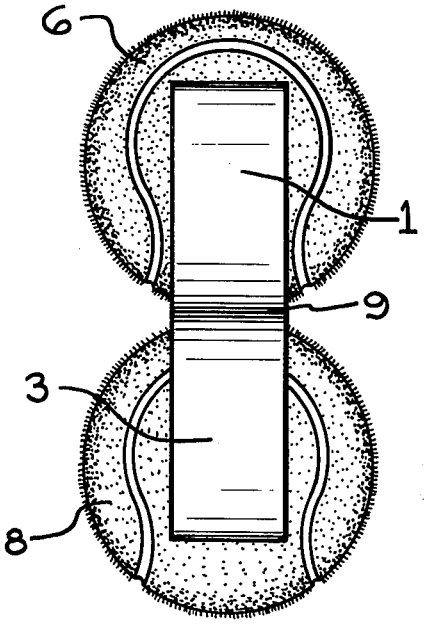
FIG. 1 illustrates a front elevational view of a first embodiment of the present invention which is shown holding two tennis balls.
Figure 2:
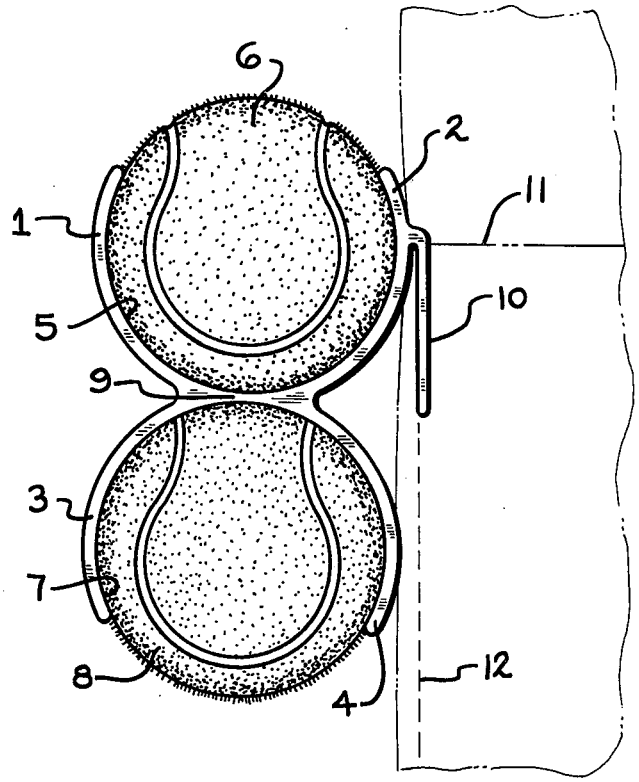
FIG. 2 depicts a side elevational view of the embodiment shown in FIG. 1 and illustrated showing the device clipped onto the shorts of the wearer thereof.

With reference to FIGS. 1 and 2, there is shown a first embodiment of the present invention including first arcuate object-retainer having an upper pair of resilient arcuate arm members 1 and 2, and a second arcuate object-retainer having a lower pair of resilient arcuate arm members 3 and 4. The pair of resilient arm members 1 and 2 have an aperture 5 therebetween into and out of which aperture 5 an arcuate object, such as a tennis ball 6, may be readily and selectively placed and removed, respectively. Similarly, the lower pair of resilient arm members 3 and 4 have an aperture 7 therebetween into and out of which aperture 7 a second arcuate object, such as a tennis ball 8, may be readily and selectively placed and removed, respectively.

The device further includes a base portion 9 to which the resilient arm members 1, 2, 3 and 4 are operably interconnected. The base portion 9 and the resilient arm members 1, 2, 3 and 4 constitute a unitary, integral one-piece structure. The base portion 9 and the resilient arm members 1, 2, 3 and 4 are arranged and interconnected so that the balls 6 and 8 can be placed into and removed from the device by merely linearly translating the balls substantially parallel to the major surface of a clip member 10 described hereinbelow. The advantages flowing from such linear translation for insertion and removal of the balls will be explained in detail hereinbelow.

A clip member 10 is integrally connected to the resilient arm member 2 for facilitating clipping the device onto a pocket edge, shorts, or other garment of the wearer of the device. In FIG. 2 the device is shown clipped to the shorts 11 of a tennis player. The dashed line 12 in FIG. 2 represents an extension of the inner plane of the clip 10. When the device is not being worn by a player, the extended plane 12 interferes slightly with the outer periphery of the resilient arm member 4. The purpose of this arrangement and configuration is to assure that the lower ball retainer is biased slightly outwardly from the body of the player by bearing against the leg or thigh of the player as shown in FIG. 2. The ultimate purpose of this feature is to hold the device snuggly to the body of the wearer thereof, and to prevent pivoting and wobbling of the device, and also to prevent rapping or swinging of the device against the player. Consequently, as mentioned hereinabove, the substantially vertical centerline of the lower holder is slightly further from the body of the wearer of the device than the substantially vertical centerline of the upper holder hereof.

As shown in FIGS. 1 and 2, the balls 6 and 8 may be linearly translated substantially in a horizontal fashion which is substantially perpendicular to the major elongated longitudinal central axis of the major surface of clip member 10, for insertion of and removal of the balls from the device. This is quite a simple movement as compared to the awkward manipulations required of the prior art techniques. It should also be carefully noted that such horizontal linear translational movement permits insertion and removal of the balls with a minimum of force or bending moment transmitted to the clip 10 or the retaining garment 11. Thus, the wear and tear on the garment 11 is avoided such as would occur if, for example, the ball 6 was pulled upwardly as shown in FIG. 2 to remove it from the device.

Figure 3:
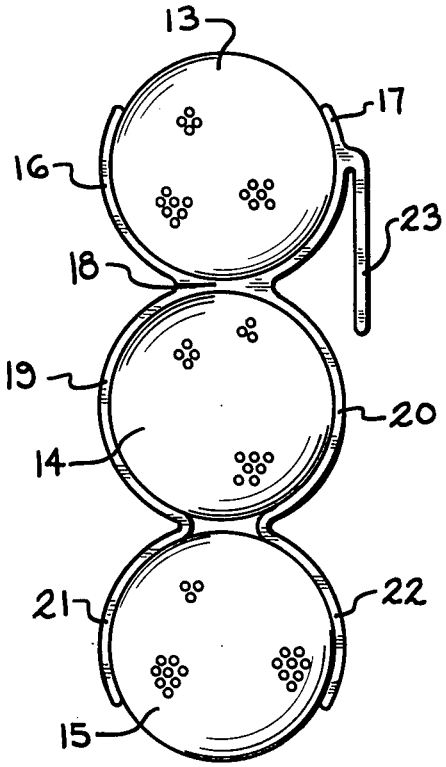
FIG. 3 illustrates a side elevational view of a second embodiment of the present invention shown holding three golf balls.

FIG. 3 shows a second embodiment of the invention for retaining three golf balls 13, 14 and 15 in a substantially vertical arrangement. The device includes a first arcuate object-retainer having an upper pair of resilient arm members 16 and 17, a base portion 18, a second arcuate object-retainer having a central pair of resilient arm members 19 and 20, from which depends a third arcuate-retainer having a lower pair of resilient arm members 21 and 22. It should be noted that there is no base portion between the central arm members 19 and 20 and the lower arm members 21 and 22 to facilitate resilient movement of such arm members and to minimize costs and difficulties in manufacturing of the device. A clip 23 is integrally affixed to the upper resilient arm member 17 for affixing to a garment, belt or pocket of the user thereof.

Figure 4:
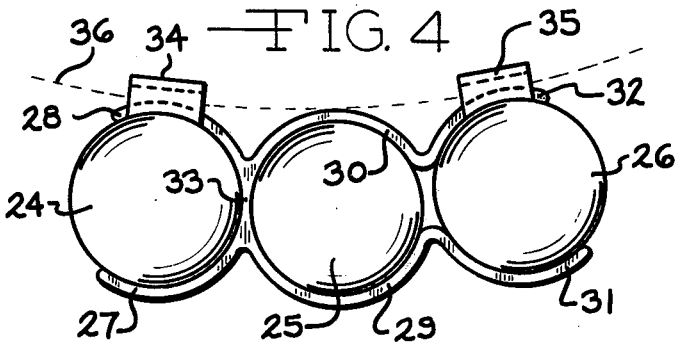
FIG. 4 illustrates a top plan view of a third embodiment of the present invention shown retaining three arcuate objects disposed in a substantially horizontal arrangement.
Figure 5:
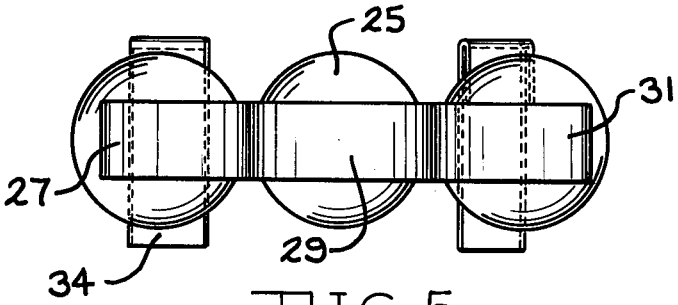
FIG. 5 depicts a front elevational view of the embodiment shown in FIG. 4.

FIGS. 4 and 5 illustrate a third embodiment of the present invention for removably retaining a plurality of arcuate objects, such as balls 24, 25 and 26 in a substantially horizontal configuration. This embodiment comprises a first arcuate object-retainer formed by a first pair of resilient arm members 27 and 28, a second arcuate object-retainer having a central pair of resilient arm members 29 and 30, and another arcuate object-retainer having a third pair of resilient arm members 31 and 32. Hereagain, only one base portion 33 is provided between the resilient arm members 27–30.

A clip member 34 is integrally affixed to arm member 28, and another clip member 35 is integrally affixed to arm member 32.

The dashed line 36 in FIG. 4 shows that the device is slightly curved to mate with the curvature of the wearer's body. It should be noted that the embodiments as set forth hereinabove can be easily fabricated from plastic materials to form a one-piece structure. However, the invention can be fabricated from wire, metal, or any other suitable material.

The invention also contemplates that the object to be held may be cylindrical in shape, such as an entire can of tennis balls, or shotgun cannisters for hunters, etc. The invention also contemplates that the individual devices may be fabricated so that they are readily interlocked to form a large display at a point of sale location, e.g., a large display for selling Leggs Pantyhose, etc.

The present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description. Furthermore, all changes which come within the meaning and range of equivalency of the appended claims are therefore intended to be embraced therein.

I claim:

1. A device for readily and removably holding at least one arcuate object, comprising:

a clip member for removably attaching said device to an item worn by a user thereof;

said clip member having its major surface disposed in a predetermined plane;

said major surface of said clip member having a major elongated longitudinal central axis;

at least one first arcuate object-retainer which is mechanically and operably connected to said clip member;

at least one second arcuate object-retainer which is supported solely by said first arcuate object-retainer;

each said arcuate object-retainer having two and only two arcuate arm members for removably holding said arcuate object therebetween;

said clip member and each said arcuate object-retainer being constructed, connected and arranged relative to each other so that each arcuate object may be inserted in and removed from each said arcuate object-retainer by linearly translating said arcuate object in a first direction which is substantially perpendicular to said major elongated longitudinal central axis of said major surface of said clip member and which is substantially parallel to said predetermined plane of said major surface of said clip member;

said arcuate arm members providing sole support for said arcuate objects in said arcuate object-retainer; and each said arcuate object-retainer providing sole support for the arcuate object which is removably held therein.

2. A device characterized substantially in accordance with claim 1, including:

a plurality of said arcuate arm members which are resilient and which hold a plurality of said arcuate objects in a substantially vertical arrangement said arcuate arm members being constructed and arranged so that two and only two of said arcuate arm members and no other portion of said device contacts and removably holds an arcuate object in each said arcuate object-retainer.

3. A device characterized substantially in accordance with claim 2, wherein:

a plane containing the inner surface of said clip member intersects at least one of said resilient arcuate arm members when said device is in an unstressed or unused condition.

4. A device characterized substantially in accordance with claim 2, wherein the upper and lower edges of said resilient arcuate arm members lie in substantially parallel planes.

5. A device according to claim 1, including:

a plurality of said arcuate object-retainers;

said plurality of said arcuate object-retainers having substantially parallel side edges;

said parallel side edges of all of said plurality of said arcuate object-retainers lying in a single pair of substantially parallel planes which are oriented substantially perpendicular to said first direction; and said clip member having side edges which do not extend beyond said single pair of substantially parallel planes.

* * * * *